US012134941B2

(12) United States Patent
Esparza

(10) Patent No.: US 12,134,941 B2
(45) Date of Patent: Nov. 5, 2024

(54) METHOD AND APPARATUS FOR TRANSMITTING AN ELECTRICAL SIGNAL

(71) Applicant: Expro North Sea Limited, Dyce (GB)

(72) Inventor: Jesus Minakata Esparza, Calgary (CA)

(73) Assignee: Expro North Sea Limited, Dyce (GB)

( * ) Notice: Subject to any disclaimer, the term of this patent is extended or adjusted under 35 U.S.C. 154(b) by 130 days.

(21) Appl. No.: 17/733,127

(22) Filed: Apr. 29, 2022

(65) Prior Publication Data

US 2022/0349265 A1 Nov. 3, 2022

(30) Foreign Application Priority Data

Apr. 29, 2021 (GB) ..... 2106162

(51) Int. Cl.
*E21B 17/20* (2006.01)
*E21B 47/13* (2012.01)

(52) U.S. Cl.
CPC ..... *E21B 17/206* (2013.01); *E21B 47/13* (2020.05)

(58) Field of Classification Search
CPC ..... E21B 17/206; E21B 19/22; E21B 34/10; E21B 47/12; E21B 47/13
See application file for complete search history.

(56) References Cited

U.S. PATENT DOCUMENTS 3,866,678 A 2/1975 Jeter
4,685,516 A * 8/1987 Smith ..... E21B 23/14 166/385
4,770,034 A 9/1988 Titchener
5,070,904 A * 12/1991 McMahon, Jr. ..... E21B 33/064 137/1
2002/0170711 A1 11/2002 Nuth
2018/0179855 A1* 6/2018 Messa ..... E21B 21/103

FOREIGN PATENT DOCUMENTS

AU 2019100328 A4 * 5/2019
EP 3006801 A2 * 4/2016 ..... E21B 23/00
WO 2016081155 A1 5/2016
WO 2021072447 A1 4/2021

OTHER PUBLICATIONS

Fuehrer, W et. al, European Patent No. EP 3 006 801 A2 "Coiled-Tubing"-Type Flexible Pipe and Production Method, Apr. 13, 2016, English translation. (Year: 2016).*
GB search report for GB2106162.7 dated Dec. 21, 2021.

* cited by examiner

*Primary Examiner* — Caroline N Butcher
(74) *Attorney, Agent, or Firm* — Getz Balich LLC

(57) ABSTRACT

A method of transmitting an electrical signal between a downhole device and a surface location is provided, the method including unwinding a flexible hose from a reel at the surface location and deploying the hose down a well-bore, wherein the downhole device is attached at a downhole end of the flexible hose, providing a conductive fluid inside the flexible hose as an electrical path, and transmitting the electrical signal through the conductive fluid from one of the downhole device and the surface location to the other of the downhole device and the surface location.

15 Claims, 4 Drawing Sheets

METHOD AND APPARATUS FOR TRANSMITTING AN ELECTRICAL SIGNAL

This application claims priority to GB Patent Appin. No. 2106162.7 filed Apr. 29, 2021, which is hereby incorporated herein by reference in its entirety.

BACKGROUND OF THE INVENTION

1. Technical Field

The present invention generally relates to downhole communication, and specifically to an apparatus and a method of transmitting an electrical signal from one of a downhole device and a surface location to the other of the downhole device and the surface location.

2. Background Information

Well intervention in the oil and gas industry is an operation carried out during, or at the end of, the production life of a well that alters the state of a wellbore of the well, provides wellbore diagnostics or data, or manages the production of the well. Examples of intervention work include well stimulation, which involves the treatment of a reservoir formation with a stimulation fluid, such as an acidic fluid, to enable enhanced production of reservoir fluid; memory logging from one or more downhole tools; and placing or recovering wellbore equipment such as plugs, gauges and valves.

Intervention may involve the use of wireline or coiled tubing. Wireline operations involve introducing one or more of a cable, wireline or slickline into a wellbore. A wireline is an electrical cable used to lower tools into a wellbore and transmit data about the conditions of the wellbore sometimes referred to as wireline logs. A slickline is a thin cable introduced into a wellbore to deliver and retrieve tools downhole.

Wireline operations may involve running a cable into a wellbore from a vessel or platform. A tool may be attached to the cable and the weight of the tool, or additional weight, may assist in running the tool into the wellbore. Generally, wireline operations have a relatively small footprint and require few personnel to implement. However, wireline operations do not allow for hydraulic fluid communication between the surface, and the tool or downhole equipment.

Coiled tubing generally comprises a long metal pipe, normally 25 to 83 mm (approximately 1 to 3.25 inches) in diameter, which is supplied on a reel at surface. Coiled tubing is generally made of steel alloy and is significantly heavier than wireline. The coiled tubing is deployed via a tubing guide (goose neck) which is an arch that guides the tubing from its stored horizontal orientation on the reel into a vertical orientation for running into the well. The arch may be provided with a series of rollers spaced along the length of coiled tubing to reduce friction as the coiled tubing passes along the arch. An injector head is usually used to push coiled tubing into the wellbore or pull the coiled tubing out of the wellbore when the particular intervention operation is complete. A typical injector head consists of a pair of endless chains each mounted on a pair of spaced sprockets and each having a straight run engaging the coiled tubing. The coiled tubing is compressed between the chains, which are hydraulically driven to push the tubing downwardly into the wellbore or pull it upwardly out of the wellbore.

While coiled tubing offers hydraulic communication and high circulation rate, it is generally heavy, bulky and time consuming to plan and mobilize. In particular, coiled tubing may involve significant rig-up and lifting (approximately two to three days); considerable cost (more than 1 million USD); a high number of personnel (11 or more); and a relatively heavy and large footprint. Furthermore, coiled tubing may only be deployed on large rigs or platforms or spooled from a vessel.

In recent times, thermoplastic coiled tubing has been proposed. This tubing is lighter than steel and its flexibility and greater ductility means that it suffers less from fatigue during a lifetime involving multiple operations.

SUMMARY OF THE INVENTION

The present invention aims to provide new operational uses and improved versatility of flexible coiled tubing.

Viewed from one aspect, the invention provides a method of transmitting an electrical signal between a downhole device and a surface location, the method comprising: unwinding a flexible hose from a reel at the surface location and deploying the hose down a wellbore, wherein the downhole device is attached at a downhole end of the flexible hose; providing a conductive fluid inside the flexible hose as an electrical path; and transmitting the electrical signal through the conductive fluid from one of the downhole device and the surface location to the other of the downhole device and the surface location.

Viewed from another aspect, the invention provides an apparatus for transmitting an electrical signal between a downhole device and a surface location, the apparatus comprising: a flexible hose configured to be unwound from a reel at the surface location and deployed into a wellbore, wherein the downhole device is attached at a downhole end of the flexible hose, and wherein the flexible hose is configured to receive a conductive fluid, the conductive fluid providing an electrical path between the surface location and the downhole device; and a surface communication unit for transmitting the electrical signal to the downhole device and/or receiving the electrical signal from the downhole device through the conductive fluid.

As a result of this arrangement, wherein the fluid communication path of the flexible hose is filled with a conductive fluid in order to provide an electrical communication path between the surface location and the downhole device, additional electrical communication paths (e.g. electrical cables) are not required to be included within the flexible hose. As such, the size and weight of the flexible hose may be decreased without any loss of functionality, and/or the volume of the fluid line of the flexible hose can be configured for optimal fluid communication/transport. The additional function of the fluid communication space of the flexible hose also improves the versatility and flexibility of use of the flexible hose.

Issues relating to stretching of the hose due to its own weight, and related stretching of electrical cables within the flexible hose, may be at least partially avoided. If the flexible hose stretches, an electrical signal can still be transmitted reliably via the conductive fluid.

The conductive fluid may be an aqueous solution, such as brine. The conductive fluid may be a metallic liquid, such as mercury.

The conductive fluid may comprise conductive particulates. The conductive particulates may be nanoparticles. The nanoparticles may be made from one or more of $Fe_3O_4$, CuO, Ag, SiC, Graphene Oxide (GO), $Fe_2O_3$, $Al_2O_3$, ND-Ni, $TiO_2$ and $SiO_2$.

The method may comprise introducing conductive particulates into the conductive fluid to increase conductivity. The conductive particles may be introduced into the conductive fluid before or after the conductive fluid is provided inside the flexible hose.

The method may comprise increasing the concentration of electrolytes in the aqueous solution. Increasing the concentration of electrolytes in the aqueous solution may comprise introducing electrolytes into the conductive fluid before or after the conductive fluid is provided inside the flexible hose.

The electrical signal may be a data communication signal.

The electrical signal may be a power signal.

An outer wall of the flexible hose may comprise a flexible material. The flexible material may take the form of a flexible layer. The flexible material or layer may be a tensile membrane. The tensile membrane may be configured to stretch when connected to the downhole device deployed downhole. The flexible material may be a polymer material, preferably a thermoplastic material.

The flexible hose may further comprise a conductor embedded in a wall of the flexible hose. The conductor may provide a second electrical path between the downhole device and the surface location.

The wall of the flexible hose may comprise multiple layers. An outer layer of the flexible hose may be made of a flexible polymer material, preferably a thermoplastic material. At least one layer of the flexible hose may be a metal reinforcement. The metal reinforcement may comprise multiple layers of high tensile steel wires, e.g. a steel mesh. The metal reinforcement may act as the conductor providing the second electrical path.

An inner layer/inner wall of the flexible hose may define a fluid line of the flexible hose. A fluid line may take the form of a tube. The inner layer/inner wall of the flexible hose may electrically isolate the first electrical path provided by the conductive fluid from the second electrical path provided by the metal reinforcement. The fluid communication path of the flexible hose may be provided by one or more fluid lines. Each fluid line may be configured to provide fluid communication between the surface location and the downhole device. Conductive fluid may be provided to each fluid line and each fluid line may act as a distinct electrical path between the surface location and the downhole device.

The reel may comprise a swivel connection for connecting a surface end portion of the flexible hose to a source of the conductive fluid.

The swivel connection may electrically couple the surface end portion of the flexible hose to the surface communication unit for transmitting the electrical signal to the downhole device and/or receiving the electrical signal from the downhole device.

The swivel connection may comprise an electrode configured to electrically couple to the conductive fluid. The electrode allows a signal to be transmitted into the conductive fluid, such that a signal may be transferred between the surface communication unit and the conductive fluid.

The surface communication unit is for communicating data to the downhole device and/or receiving data from the downhole device.

The surface communication unit may be located at the surface location. The surface location may be a drill rig, vessel, drilling platform or mobile offshore drilling unit (MODU). The surface communication unit may comprise a controller for controlling operation of the downhole device. The controller of the surface communication unit may comprise a processor and a memory. The processor may process data stored in the memory. The processor may process data received from the downhole device and/or control operation of the downhole device. The memory stores commands for operation of the memory and/or stores data received from the downhole device.

The second electrical path may be used to ground the electrical signal. As such, the second electrical path may be connected to a ground of the surface communication unit. Advantageously, grounding the system improves conduction of the electrical signal and provides signal noise reduction.

The surface communication unit may comprise, or be associated with, one or more valves and one or more pumps. The surface communication unit may be configured to control the one or more valves and one or more pumps to deliver fluid from a fluid source to a fluid line (fluid communication path) of the flexible hose.

The apparatus may further comprise a pressure compensation device configured to maintain a constant hydraulic pressure of the conductive fluid in the flexible hose.

By maintaining a constant hydraulic pressure of the conductive fluid in the flexible hose, movement of the conductive fluid within the hose is restricted. Preferably, the pressure compensation device is configured to keep the conductive fluid in the flexible hose static. Thus, transmission of the electrical signal through the conductive fluid (which requires the flow of charged particles within the conductive fluid) is not disrupted by movement of the conductive fluid within the flexible hose.

The pressure compensation device may comprise one or more of a piston, an elastic membrane or a bladder configured to pressurize the conductive fluid.

The downhole device may be attached to the downhole end of the flexible hose by a connecting portion. The connecting portion may be remotely releasable. The downhole device may be connected to the downhole end of the flexible hose prior to deploying the hose down the well. Alternatively, the downhole device may be first positioned in the wellbore, and the flexible hose run into the wellbore and connected to the downhole device. The downhole device may be in fluid and/or electrical communication with one or more fluid lines of the flexible hose.

The downhole end of the flexible hose may be secured between a hose insert and a crimping sleeve. The hose insert and the crimping sleeve may be electrically connected to each other. The hose insert and/or the crimping sleeve may be electrically connected to the connecting portion.

The crimping sleeve and/or the hose insert may comprise a penetrating portion. The penetrating portion, during a crimping process in which the downhole end of the flexible hose is secured between the hose insert and the crimping sleeve, may be configured to penetrate through an outer layer and/or an inner layer of the flexible hose and establish an electrical connection with the metal reinforcement. The penetrating portion may comprise a plurality of spikes and/or protrusions configured to penetrate through the outer layer and/or the inner layer.

The connecting portion may comprise an electrode configured to electrically couple the downhole device to the conductive fluid.

The connecting portion may comprise a port configured to allow fluid in the flexible hose to be circulated out of the hose.

The connecting portion may comprise a valve member responsive to pressure of fluid in the flexible hose to open the port above a certain pressure.

The valve member may comprise the electrode.

The method may further comprise pumping a fluid out of the flexible hose before providing the conductive fluid inside the flexible hose.

The method may comprise using a fluid in the flexible hose to provide hydraulic control of the downhole device, before pumping the fluid out of the flexible hose.

The method may comprise using the conductive fluid in the flexible hose for hydraulic control of the downhole device (or other conventional fluidic operations) before or after using the conductive fluid in the flexible hose for electrical communication with, and/or control of, the downhole device. The method may comprise using the conductive fluid in the flexible hose for hydraulic control of the downhole device (or other conventional fluidic operations) before or after introducing conductive particles into the conductive fluid and using the conductive fluid in the flexible hose for electrical communication with, and/or control of, the downhole device. The method may comprise using the conductive fluid in the flexible hose for hydraulic control of the downhole device (or other conventional fluidic operations) before or after increasing the concentration of electrolytes in the conductive fluid and using the conductive fluid in the flexible hose for electrical communication with, and/or control of, the downhole device.

The downhole device may comprise a downhole tool requiring power no more than 1000 Watts. The downhole device may comprise a downhole tool requiring power no more than 100 Watts. The downhole device may comprise a downhole tool requiring power no more than 10 Watts. The downhole device may comprise a downhole tool requiring power no more than 2 Watts.

The downhole device may weigh down the flexible hose during deployment. The downhole device may comprise a bottom hole assembly (BHA). The BHA may comprise one or more downhole tools. Specifically, the BHA may comprise one or more of a drill bit, mud motor, stabilizers, drill collar, drillpipe, jarring devices (jars), crossovers for various threadforms, end connector, dual flapper valves, straight pull release components, swivel assembly, eight board, turbine and cleaning nozzles. Each downhole tool may be connected to a same or different corresponding fluid line of the flexible hose.

The downhole device may comprise one or more sensors configured to detect a downhole parameter such as pressure, stress, strain, temperature, resistivity, force, current, voltage, shock, vibration and flow rate.

The method may comprise simultaneously using at least one fluid line to provide hydraulic control of the downhole device and using at least one other fluid line to provide electrical communication with the downhole device.

BRIEF DESCRIPTION OF THE DRAWINGS

Certain preferred embodiments of the invention will now be described, by way of example only, with reference to the accompanying drawings in which.

DETAILED DESCRIPTION OF THE INVENTION

Figure 1:
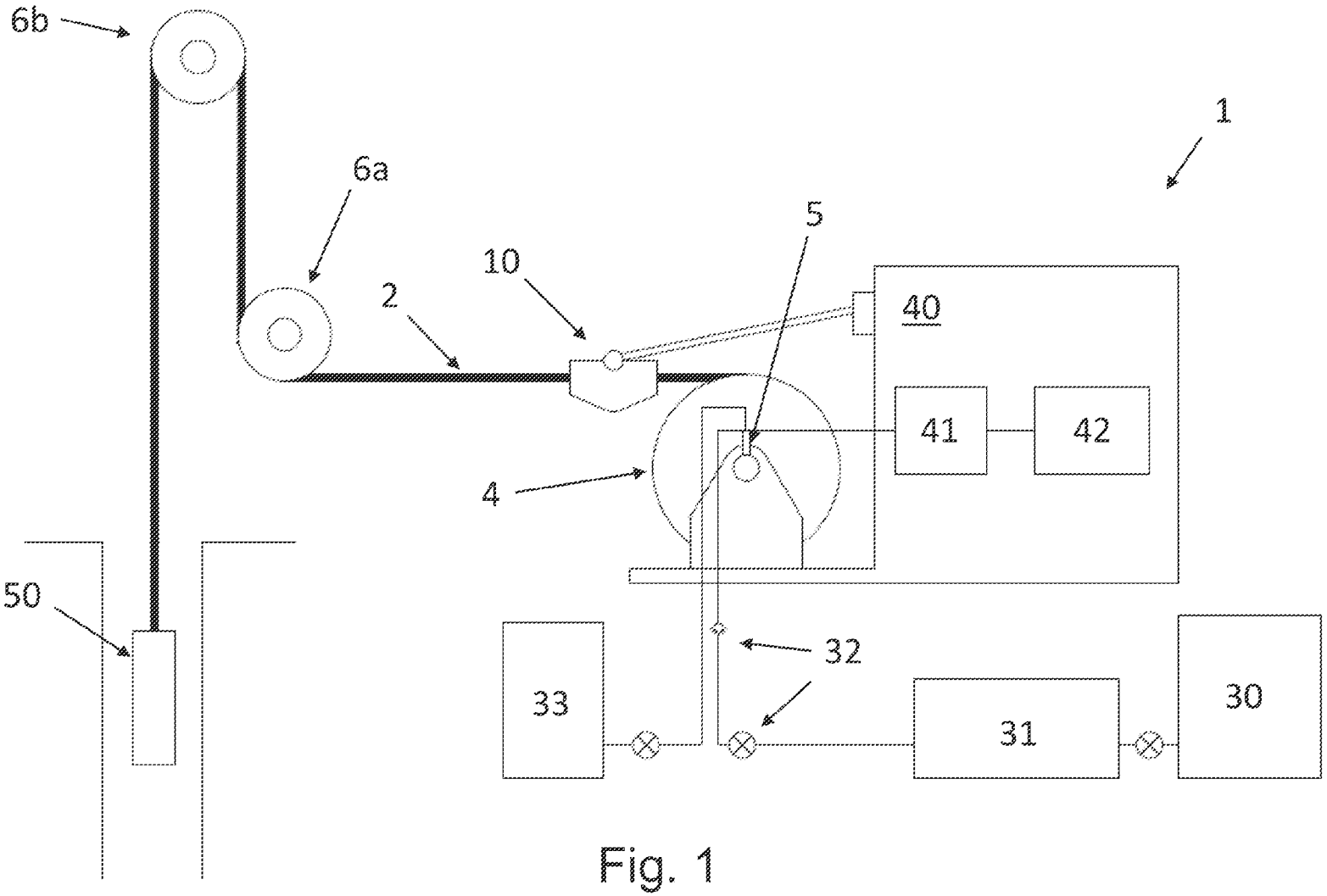
FIG. 1 is a schematic view showing the general layout of an apparatus for transmitting an electrical signal between a downhole device and a surface location.

FIG. 1 shows an apparatus 1 for transmitting an electrical signal between a downhole device 50 and a surface location. The downhole device 50 is shown to be deployed down a wellbore. The wellbore may be part of an offshore or onshore well. The well may be a production well, abandoned well or the like. In FIG. 1, the well is a subsea well.

The apparatus 1 comprises a flexible hose 2, which is configured to be run into the wellbore, for example during a well intervention process, and to provide a fluid communication path from the surface into the wellbore. The flexible hose 2 is provided on a reel 4. The flexible hose 2 may be initially, i.e. prior to deployment, wound on the reel 4. The reel 4 includes a pulling mechanism, which can also provide a back tension function. The reel 4 may comprise a motor. The flexible hose 2 may be unwound from the reel 4 during deployment in a wellbore as will be described.

The flexible hose 2 extends from the reel 4 to a depth and tension device 10. The depth and tension device 10 feeds the flexible hose 2 in a controlled manner to a lower sheave 6*a* then vertically upward to an upper, guiding sheave 6*b* which guides the flexible hose 2 to the wellbore. The guiding sheave 6*b* deviates the flexible hose 2 from an upwardly inclined direction to a vertical downward direction, towards a wellbore. While a guiding sheave 6*b* has been shown in FIG. 1, the flexible hose 2 may be unwound directly from the reel 4 into the wellbore.

The flexible hose 2 is associated at one end to a surface communication unit 40 positioned at a surface location, and at the other end to the downhole device 50.

The surface communication unit 40 comprises a power supply 41 and a control system 42 comprising a processor and a memory. The processor may process data stored in the memory. The processor of the control system 42 processes data received from the downhole device 50 and/or controls operation of the downhole device 50. The memory of the control system 42 stores commands for operation of the control system 42 and/or stores data received form the downhole device 50.

The downhole device 50 may comprise a downhole tool requiring power no more than 1000 Watts. The downhole device 50 may comprise a downhole tool requiring power no more than 100 Watts. The downhole device 50 may comprise a downhole tool requiring power no more than 10 Watts. The downhole device 50 may comprise a downhole tool requiring power no more than 2 Watts. The downhole device 50 may comprise at least one of a measurement device (e.g. gauge, well logging tool), a flow control device (e.g. valve), a perforating device (e.g. perforating gun) and a setting device (e.g. plug, packer). The downhole device 50 is positioned at a site of operation in the wellbore. The downhole device 50 is positioned downhole of the surface communication unit 40.

At the surface location, a fluid source 30 provides fluid to the flexible hose 2, e.g. for hydraulic operation of the downhole device 50. The fluid source 30 provides fluid for supplying hydraulic pressure to operate or control the downhole device 50. Accordingly, the fluid source 30 may be connected to the flexible hose 2 via one or more pumps 31 and one or more valves 32. The one or more pumps 31 and one or more valves 32 may be associated with the surface communication unit 40, for example being connected to and controlled by surface communication unit 40.

In accordance with an embodiment of the invention, the fluid source 30 provides the flexible hose 2 with a conductive fluid 3. The conductive fluid 3 in the flexible hose 2 functions as an electrical path between the surface location, particularly the surface communication unit 40, and the downhole device 50. In other words, when the flexible hose 2 is filled with the conductive fluid 3, the fluid communication path of the flexible hose 2 serves as an electrical communication path.

A wall 20 of the flexible hose 2 may be made of a flexible polymer material, preferably a thermoplastic material. The flexible hose 2 may comprise a conductor embedded in the wall 20. The conductor may be electrically isolated from the conductive fluid in order to provide a second electrical path between the downhole device and the surface location.

Figure 3:
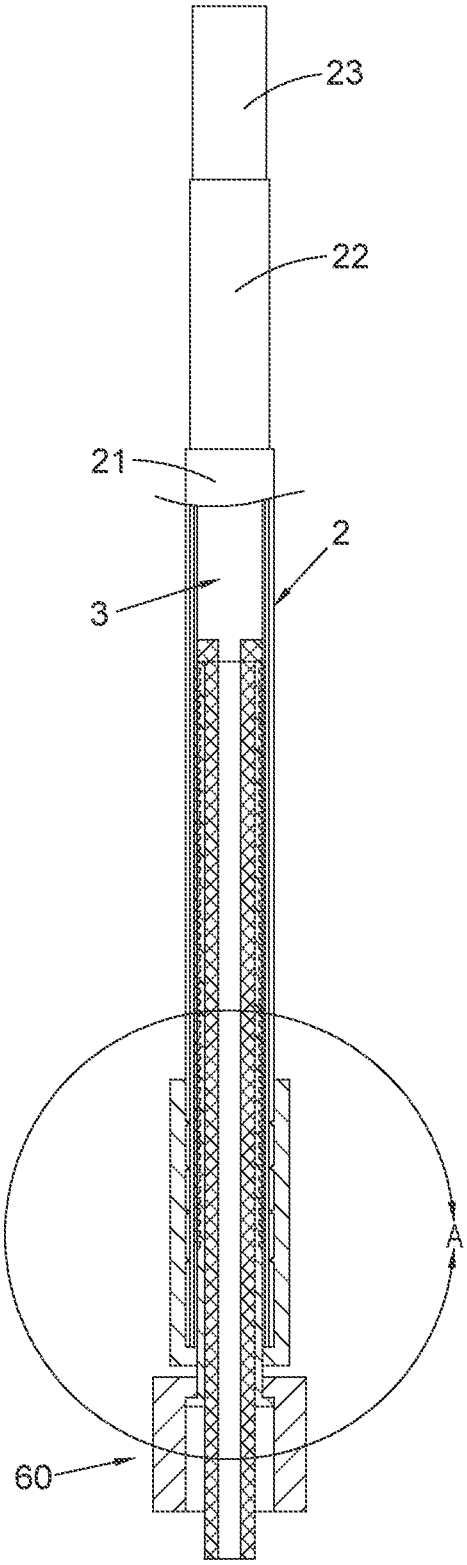
FIG. 3 is a schematic sectional view of a downhole end of a flexible hose.

In the described embodiment, the wall 20 of the flexible hose 2 comprises multiple layers (e.g. as shown in FIG. 3). An outer layer 21 of the flexible hose 2 is made of a flexible polymer material, preferably a thermoplastic material.

At least one layer of the flexible hose 2 is a metal reinforcement 22. The metal reinforcement 22 may comprise one or more layers of high tensile steel wires, e.g. a steel mesh. The metal reinforcement 22 acts as the conductor providing the second electrical path. Alternatively, the conductor may be an electrical wire/cable embedded in one of the flexible polymer layers of the wall 20. However, providing the metal reinforcement 22 as a second electrical path as well as providing structural reinforcement can assist in reducing the weight of the flexible hose 2.

An inner layer/inner wall 23 of the flexible hose 2 may define a fluid line of the flexible hose 2. In other words, a fluid line may take the form of a tube. The inner layer/inner wall 23 of the flexible hose 2 may electrically isolate the first electrical path provided by the conductive fluid from the second electrical path provided by the metal reinforcement. The fluid communication path of the flexible hose may be provided by one or more fluid lines. Each fluid line may be configured to provide fluid communication between the surface location and the downhole device. Thus, conductive fluid may be provided to each fluid line and each fluid line may act as a distinct electrical path between the surface location and the downhole device.

The electrical path(s) of the flexible hose 2 are electrically connected to the surface communication unit 40 such that a signal may be transferred between the surface communication unit 40 and the conductive fluid.

Figure 2:
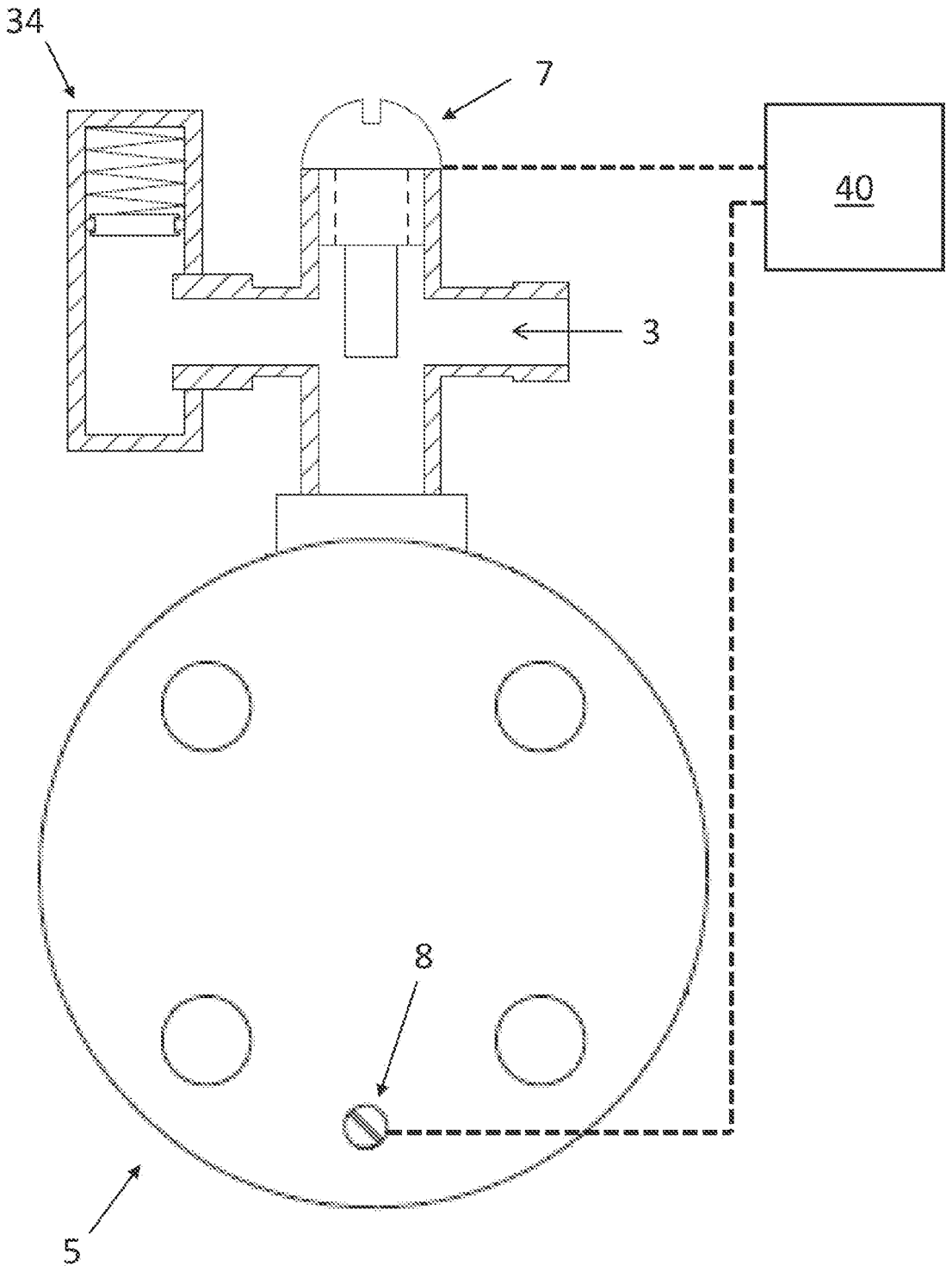
FIG. 2 is a schematic view of a swivel connection of a reel at a surface location.

In the embodiment shown in FIG. 2, the flexible hose 2 is electrically connected to the surface communication unit 40 by the reel 4.

The reel 4 comprises a swivel connection 5 for the hose at its center. Preferably, the swivel connection 5 is a pressure tight swivel connection and the reel 4 is rotatable around the centerline of the swivel connection 5.

The swivel connection 5 is connected to the end of the flexible hose 2 remote from the well, i.e. the non-downhole end of the hose 2. The non-rotating end of the swivel connection 5 is fluidly connected to the fluid source 30.

The non-rotating end of the swivel connection 5 is connected to pressure compensation device 34. The pressure compensation device 34 is configured to keep the fluid inside the flexible hose 2 static by maintaining a constant hydraulic pressure of the fluid in the flexible hose 2. The pressure compensation device 34 may comprise one or more of a piston, an elastic membrane or a bladder configured to keep the flexible hose 2 completely filled with the conductive fluid 3 and work as well as an air trap. Thus the electrical path between the surface communication unit 40 and the downhole device 50 can be maintained.

The swivel connection 5 comprises an electrode 7 configured to electrically couple to the conductive fluid 3. The electrode 7 is electrically connected to the surface communication unit 40. As such, the electrode 7 of the swivel connection 5 allows a signal to be transferred between the surface communication unit 40 and the conductive fluid 3.

The swivel connection 5 also provides an electrical connection 8 between the metal reinforcement (second electrical path) 22 of the flexible hose 2 and a ground of the surface communication unit 40. The swivel connection 5 is configured to maintain electrical isolation of the first electrical path provided by the conductive fluid 3 from the second electrical path provided by the metal reinforcement 22.

Figure 3A:
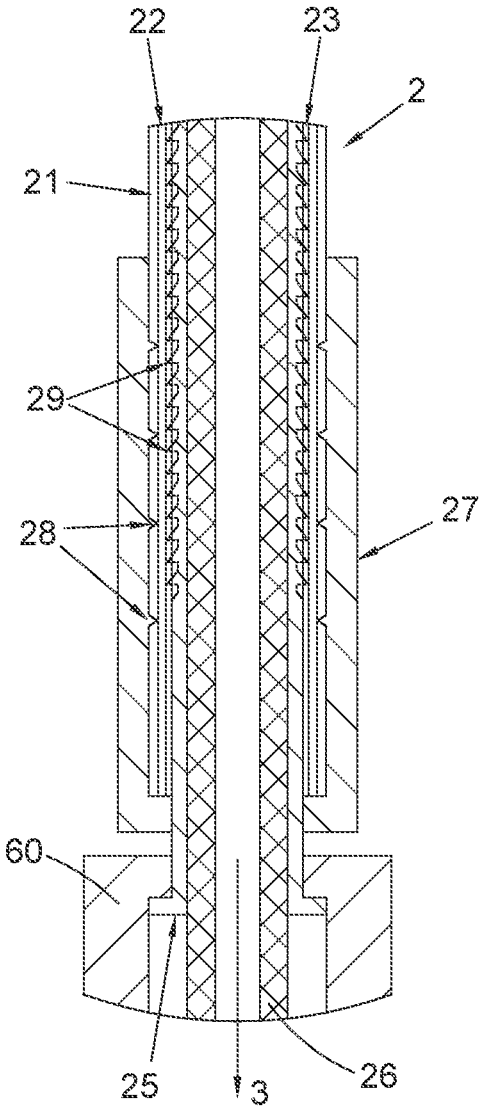
FIG. 3A is an enlarged schematic view of the downhole end of the flexible hose 2 of FIG. 3.
Figure 4:
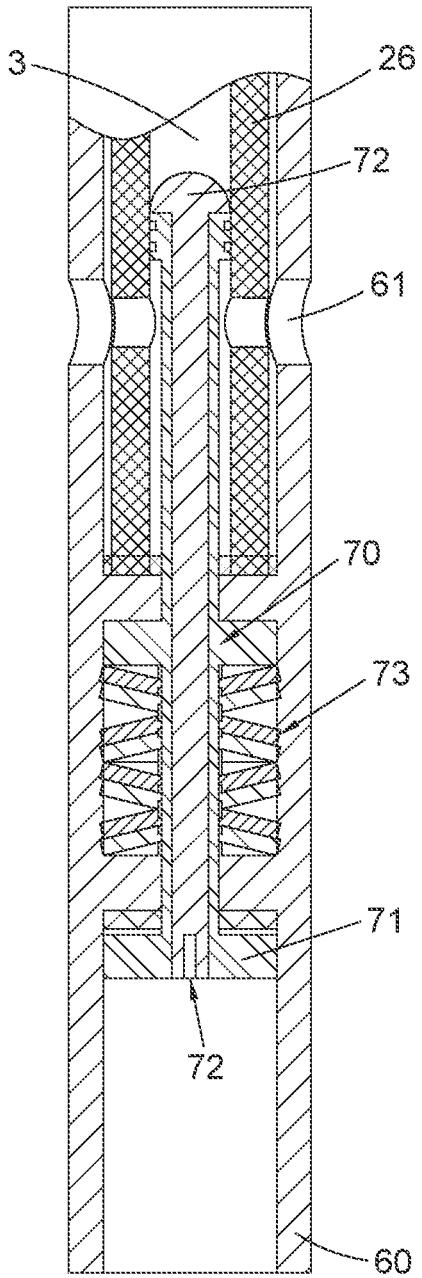
FIG. 4 is a schematic sectional view of a connecting portion for connecting a downhole device to a downhole end of a flexible hose.

With reference to FIGS. 3, 3A and 4, there is shown a connecting portion 60 for connecting the downhole device 50 to the downhole end of the flexible hose 2. In FIGS. 3 and 3A, an upper end of the connecting portion 60 is shown connected to the downhole end of the flexible hose 2. The connecting portion 60 extends downwardly to a lower portion as shown in FIG. 4, which is configured for connection to the downhole device.

As can be seen in FIG. 3A, a hose insert 25, which surrounds an insulated sleeve 26, is inserted into the downhole end of the flexible hose 2. The hose insert 25 can be inserted into the end of the flexible hose 2 at the surface, prior to deploying the flexible hose 2 down the wellbore.

In order to secure the hose insert 25 in the downhole end of the flexible hose 2, a crimping sleeve 27 is placed around the end of the hose 2 and the sleeve is subsequently crimped, e.g. by applying a force in a radially inward direction. Thus the end of the hose 2 is held securely between the crimping sleeve 27 and the hose insert 25.

As an additional result of the radially inward force applied during the crimping process, the crimping sleeve 27 is brought into physical contact with the metal reinforcement 22 of the flexible hose 2, by penetrating the outer layer 21 of the flexible hose 2. Thus the crimping process, in securing the attachment of the downhole device 50 to the flexible hose 2, also establishes an electrical connection between the metal reinforcement 22 and the hose insert 25. The crimping sleeve 27 may comprise a penetrating portion 28 to facilitate the penetration of the outer layer 21 of the flexible hose 2 and to strengthen the electrical connection between the metal reinforcement 22 and the crimping sleeve 27. The penetrating portion 28 may comprise a plurality of spikes and/or protrusions configured to penetrate through the outer layer 21. Alternatively or additionally, during the crimping process the hose insert 25 may be brought into physical contact with the metal reinforcement 22 of the flexible hose 2, by penetrating an inner layer 23 of the flexible hose 2. Thus, the hose insert 25 may also comprise a penetrating portion 29 to facilitate the penetration of the inner layer 23 of the flexible hose 2 and to strengthen the electrical connection between the metal reinforcement 22 and the hose insert 25. The penetrating portion 29 may comprise a plurality of spikes and/or protrusions configured to penetrate through the inner layer 23.

The crimping sleeve 27 and/or the hose insert 25 may be electrically connected to the connecting portion 60 to extend the electrical connection from the metal reinforcement 22 of the flexible hose 2 to the downhole device 50.

The insulated sleeve 26 is fluidly connected to the fluid line of the flexible hose 2. The insulated sleeve 26 defines an electrically insulated fluid path through the hose insert 25 and the connection portion 60, to a valve member 70. The insulated sleeve 26 electrically isolates the fluid path from the hose insert and the connection portion 60.

The valve member 70 controls the fluid flow through a fluid communication port 61. The fluid communication port 61 comprises one or more holes extending through the insulated sleeve 26 and connecting portion 60. Fluid may be circulated out of the flexible hose 2 by flowing through the insulated sleeve 26 and out through the port 61.

Valve member 70 comprises an insulated body 71 and, in the described embodiment, is acted upon by a pressure biasing means (e.g. a spring assembly) 73. Accordingly, the valve member 70 of the described embodiment is operated by the pressure of the fluid. If it is desired to circulate fluid out of the flexible hose 2, fluid is pumped into the hose 2 to increase the internal pressure. Once the pressure in the fluid line of the hose 2 exceeds a certain value determined by the force provided by the pressure biasing means 73, the valve member 70 is displaced downwardly revealing port 61. This allows the fluid to flow through the port 61.

In an alternative embodiment, the valve member 70 may be a solenoid valve remotely controlled by electronic communication through the second electrical path.

In the described embodiment, valve member 70 additionally comprises an electrode 72. The electrode 72 is configured to electrically couple to the conductive fluid 3 inside the insulated sleeve 26. As seen in FIG. 4, the electrode 72 may extend through the insulated body 71 of the valve member 70 to the downhole device 50 end of the connecting portion 60. As such, the electrode 72 of the connecting portion 60 allows a signal to be transferred between the downhole device 50 and the conductive fluid 3.

The insulated body 71 of the valve member 70 ensures that the electrode 72 is electrically insulated from the structure of the connecting portion 60. Thus the downhole device 50 can be electrically connected to a first electrical path provided by the conductive fluid 3. Furthermore, in this embodiment, where the connection portion 60 is electrically connected to the metal reinforcement 22, the downhole device 50 can be electrically connected to a second electrical path provided by the metal reinforcement 22.

A method of transmitting an electrical signal between a downhole device 50 and a surface location, in connection to the system above, is now described.

The method comprises unwinding the flexible hose 2 from the reel 4 at the surface location and deploying the hose 2 down the wellbore.

Deploying the hose down the wellbore may comprise first attaching the downhole device 50 to the downhole end of the flexible hose 2. Alternatively, the downhole device 50 may be attached to the downhole end of the flexible hose 2 after the hose 2 has been deployed.

The method may further comprise electrically connecting the surface communication unit 40 to the reel 4.

Attaching the downhole device 50 to the downhole end of the flexible hose 2 may comprise electrically coupling the downhole device 50 to the electrical path of the flexible hose 2 provided by the conductive fluid 3. Attaching the downhole device 50 to the downhole end of the flexible hose 2 may further comprise electrically coupling the downhole device 50 to the second electrical path of the flexible hose 2 provided by the metal reinforcement 22 embedded in a wall of the flexible hose 2.

As discussed above, electrically coupling to the conductive fluid 3 may be achieved by electrodes such that electrical signals may be transmitted into and received from the conductive fluid 3.

The method further comprises providing a conductive fluid 3 inside the flexible hose 2. The conductive fluid 3 can act as an electrical path.

The method further comprises transmitting an electrical signal through the conductive fluid 3 from one of the downhole device 50 and the surface location to the other of the downhole device 50 and the surface location.

The method may comprise positioning the downhole device 50 in the wellbore. Electrical communication with the downhole device 50 may help to position the downhole device 50 in the wellbore. Alternatively, the downhole device 50 may be positioned in the wellbore before conductive fluid 3 is provided inside the flexible hose 2 to establish electrical communication between the surface location and the downhole device 50.

Transmitting the signal may comprise communicating an actuation signal from the surface communication unit 40 through the conductive fluid to the downhole device 50 to actuate the downhole device 50. Thus, the electrical signal being transferred may be a power signal.

The downhole device 50 may be controlled to monitor parameters such as pressure, temperature, electrical resistivity and conductivity, strain and/or force. Accordingly, transmitting the signal may comprise communicating data from the downhole device 50 through the conductive fluid 3 to the surface communication unit 40. Thus, the electrical signal being transmitted may be a data communication signal.

The method may further comprise pumping a fluid out of the flexible hose 2 before providing the conductive fluid 3 inside the flexible hose 2.

The method may further comprise introducing conductive particles into the conductive fluid 3 to increase conductivity. Preferably, the conductive fluid 3 may be an aqueous solution such as brine. Preferably, the conductive particles may be nanoparticles. The nanoparticles may be made from one or more of $Fe_3O_4$, CuO, Ag, SiC, Graphene Oxide (GO), $Fe_2O_3$, $Al_2O_3$, ND-Ni, $TiO_2$ and $SiO_2$. The conductive particles may be introduced into the conductive fluid 3 before or after the conductive fluid 3 is provided inside the flexible hose 2.

Alternatively or additionally, where the conductive fluid 3 is an aqueous solution, the method may comprise increasing the concentration of electrolytes in the aqueous solution. Increasing the concentration of electrolytes in the aqueous solution may comprise introducing electrolytes into the conductive fluid 3 before or after the conductive fluid 3 is provided inside the flexible hose 2.

The method may further comprise using a fluid in the flexible hose 2 to provide hydraulic control of the downhole device 50. The fluid may be a conductive fluid 3, but may also be a non-conductive fluid.

Similarly, the method may comprise using the flexible hose 2 for conventional fluidic operations of the downhole device 50 before or after providing the conductive fluid 3 inside the flexible hose 2 for electrical communication with the downhole device 50.

The method may comprise using the conductive fluid 3 in the flexible hose 2 for conventional fluidic operations of the downhole device 50 before or after using the conductive fluid 3 in the flexible hose 2 for electrical communication with the downhole device 50. The method may comprise using the conductive fluid 3 in the flexible hose 2 for conventional fluidic operations of the downhole device 50 before or after introducing conductive particles into the conductive fluid 3 and using the conductive fluid 3 in the flexible hose 2 for electrical communication with the downhole device 50. The method may comprise using the conductive fluid 3 in the flexible hose 2 for conventional fluidic operations of the downhole device 50 before or after increasing the concentration of electrolytes in the conductive fluid 3 and using the conductive fluid 3 in the flexible hose 2 for electrical communication with the downhole device 50.

The above concept can be explained by way of specific example: in an embodiment of the invention the downhole device 50 may include a caliper and clean up devices. The caliper can be electrically controlled via the conductive fluid 3 in the flexible hose 2 and the data that is collected is transmitted to the surface via the conductive fluid 3 in the flexible hose 2. Next, clean up fluid, such as brine (which may also have been used as the conductive fluid 3) may be pumped downhole via the flexible hose 2.

Once clean-up has been completed, electrical communication with the caliper may be re-established with the surface by filling the flexible hose 2 with the conductive fluid 3, and the caliper can be re-run to verify the clean-up. Thus, complete clean-up operation(s) can be achieved by the fluid line of the flexible hose 2 without requiring additional electrical connections, which would reduce the volume of the fluid line.

In embodiments wherein the system further comprises metal reinforcement 22 embedded in the wall of the flexible hose 2, or wherein the flexible hose 2 comprises more than one fluid line, additional electrical paths can be established between the surface location and the downhole device 50 without requiring system modifications. Accordingly, operational versatility may be improved without reducing the volume of fluid that can be conveyed by the flexible hose 2 or increasing the size and/or weight of the flexible hose 2.

For example, the method may comprise simultaneously using at least one fluid line to provide hydraulic control of the downhole device 50 and using at least one other fluid line to provide electrical communication via conductive fluid 3 with the downhole device 50.

The invention claimed is:

1. A method of transmitting an electrical signal between a downhole device and a surface location, the method comprising:

unwinding a flexible hose from a reel at the surface location and deploying the hose down a wellbore, wherein the downhole device is attached at a downhole end of the flexible hose, and wherein a wall of the flexible hose comprises an inner layer and an outer layer, wherein the inner layer defines a fluid line configured to receive a conductive fluid, the conductive fluid providing a first electrical path between the surface location and the downhole device, and wherein the outer layer comprises a polymer and a metal reinforcement, the metal reinforcement configured to act as a conductor providing a second electrical path between the surface location and the downhole device;

providing the conductive fluid inside the flexible hose as the first electrical path; and transmitting the electrical signal from the downhole device to the surface location, or from the surface location to the downhole device using the conductive fluid and the metal reinforcement to provide an electrical communication path between the surface location and the downhole device for the electrical signal.

2. The method of claim 1, wherein the reel comprises a swivel connection connecting a surface end portion of the flexible hose to a source of the conductive fluid, the swivel connection comprising an electrode electrically coupled to the conductive fluid.

3. The method of claim 2, wherein the swivel connection electrically couples the surface end portion of the flexible hose to a surface communication unit for transmitting the electrical signal to the downhole device and/or receiving the electrical signal from the downhole device.

4. The method of claim 1, comprising maintaining hydraulic pressure of the conductive fluid in the flexible hose using a pressure compensation device.

5. The method of claim 1, wherein the downhole device is attached to the downhole end of the flexible hose by a connecting portion, the connecting portion comprising an electrode configured to electrically couple the downhole device to the conductive fluid.

6. The method of claim 1, comprising pumping a fluid out of the flexible hose before providing the conductive fluid inside the flexible hose.

7. The method of claim 1, wherein the flexible hose comprises a plurality of fluid lines configured to receive the conductive fluid, each conductive fluid line providing an electrical path between the surface location and the downhole device.

8. An apparatus for transmitting an electrical signal between a downhole device and a surface location, the apparatus comprising:

a flexible hose configured to be unwound from a reel at the surface location and deployed into a wellbore, wherein the downhole device is attached at a downhole end of the flexible hose, and wherein a wall of the flexible hose comprises an inner layer and an outer layer, wherein the inner layer defines a fluid line configured to receive a conductive fluid, the conductive fluid providing a first electrical path between the surface location and the downhole device, and wherein the outer layer comprises a polymer and a metal reinforcement, the metal reinforcement configured to act as a conductor providing a second electrical path between the surface location and the downhole device; and a surface communication unit for transmitting the electrical signal to the downhole device and/or receiving the electrical signal from the downhole device through the conductive fluid and the metal reinforcement, the conductive fluid and metal reinforcement providing an electrical communication path between the surface location and the downhole device for the electrical signal.

9. The apparatus of claim 8, wherein the reel comprises a swivel connection for connecting a surface end portion of the flexible hose to a source of the conductive fluid, the swivel connection comprising an electrode configured to electrically couple to the conductive fluid.

10. The apparatus of claim 9, wherein the swivel connection is configured to electrically couple the surface end portion of the flexible hose to the surface communication unit for transmitting the electrical signal to the downhole device and/or receiving the electrical signal from the downhole device.

11. The apparatus of claim 8, further comprising a pressure compensation device configured to maintain hydraulic pressure of the conductive fluid in the flexible hose.

12. The apparatus of claim 8, wherein the downhole device is attached to the downhole end of the flexible hose by a connecting portion, the connecting portion further comprising an electrode configured to electrically couple the downhole device to the conductive fluid.

13. The apparatus of claim 12, wherein the connecting portion comprises a port configured to allow fluid in the flexible hose to be circulated out of the hose, and the apparatus comprising a valve member responsive to pressure of fluid in the flexible hose to open the port above a certain pressure.

14. The apparatus of claim 8, wherein the conductive fluid comprises conductive particulates.

15. The apparatus of claim 8, wherein the flexible hose comprises a plurality of fluid lines configured to receive the conductive fluid, each conductive fluid line providing an electrical path between the surface location and the downhole device.

* * * * *